US011442401B2

(12) United States Patent
Takiguchi

(10) Patent No.: US 11,442,401 B2
(45) Date of Patent: Sep. 13, 2022

(54) PROTECTION MEMBER, REPLACEMENT COMPONENT WITH PROTECTION MEMBER, AND IMAGE FORMING APPARATUS

(71) Applicant: FUJIFILM Business Innovation Corp., Tokyo (JP)

(72) Inventor: Toshio Takiguchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/157,103

(22) Filed: Jan. 25, 2021

(65) Prior Publication Data

US 2022/0100142 A1 Mar. 31, 2022

(30) Foreign Application Priority Data

Sep. 30, 2020 (JP) ..... JP2020-164282

(51) Int. Cl.
*G03G 21/16* (2006.01)

(52) U.S. Cl.
CPC ..... *G03G 21/168* (2013.01); *G03G 21/1685* (2013.01); *G03G 2221/1609* (2013.01); *G03G 2221/1639* (2013.01); *G03G 2221/1642* (2013.01); *G03G 2221/1846* (2013.01)

(58) Field of Classification Search
CPC ..... G03G 2215/0086; G03G 2215/0875
See application file for complete search history.

(56) References Cited

U.S. PATENT DOCUMENTS 7,383,000 B2 * 6/2008 Koumoto ..... G03G 21/1832 399/119
7,532,841 B2 * 5/2009 Tanaka ..... G03G 21/1832 399/108
7,929,881 B2 * 4/2011 Yoshino ..... G03G 21/1842 399/113
8,055,154 B2 * 11/2011 Iikura ..... G03G 21/1832 399/111
8,086,136 B2 * 12/2011 Hayashi ..... G03G 21/1832 399/111

(Continued)

FOREIGN PATENT DOCUMENTS

JP 08-292706 A 11/1996
JP 09127851 A * 5/1997

(Continued)

*Primary Examiner* — Leon W Rhodes, Jr.
(74) *Attorney, Agent, or Firm* — Sughrue Mion, PLLC

(57) ABSTRACT

A protection member for attachment to a replacement component before the replacement component is inserted into a body of an apparatus, to protect the replacement component, the replacement component being to be inserted into the body of the apparatus so as to act as a part of the apparatus, the protection member includes: a contact portion configured to come into contact with the body of the apparatus at a stage where a portion of the replacement component on a front side in an insertion direction is inserted into the body of the apparatus while the protection member is attached to the replacement component, in which the protection member is removed at the stage where the portion is inserted into the body of the apparatus, so as to allow further insertion of the replacement component.

19 Claims, 5 Drawing Sheets

(56) References Cited

U.S. PATENT DOCUMENTS

| | | | | |
|---|---|---|---|---|
| 8,744,311 | B2 * | 6/2014 | Sato | G03G 21/1633 399/117 |
| 9,348,305 | B2 * | 5/2016 | Kanai | G03G 21/1842 |
| 9,429,904 | B2 * | 8/2016 | Yasumoto | G03G 21/1832 |
| 9,886,001 | B2 * | 2/2018 | Katsumata | G03G 21/1832 |
| 10,303,114 | B2 * | 5/2019 | Katayama | G03G 21/185 |
| 10,527,999 | B2 * | 1/2020 | Koyama | G03G 21/185 |
| 10,969,729 | B2 * | 4/2021 | Itabashi | G03G 15/0896 |
| 2006/0216064 | A1 | 9/2006 | Koumoto et al. | |

FOREIGN PATENT DOCUMENTS

| | | | | |
|---|---|---|---|---|
| JP | 3507227 | B2 | | 12/2003 |
| JP | 2004170556 | A | * | 6/2004 |
| JP | 2006-267808 | A | | 10/2006 |

* cited by examiner

PROTECTION MEMBER, REPLACEMENT COMPONENT WITH PROTECTION MEMBER, AND IMAGE FORMING APPARATUS

CROSS-REFERENCE TO RELATED APPLICATIONS

This application is based on and claims priority under 35 USC 119 from Japanese Patent Application No. 2020-164282 filed Sep. 30, 2020.

BACKGROUND

(i) Technical Field

The present disclosure relates to a protection member, a replacement component with a protection member, and an image forming apparatus.

(ii) Related Art

An electrophotographic image forming apparatus includes an image carrier that temporarily carries a toner image. In order to allow the image carrier to be replaceable, a component including the image carrier is formed as a cartridge or a unit, and is replaced when its lifetime expires.

In order to prevent damage to the image carrier before replacement, a cartridge or a unit includes a protection member such as a protection cover. Before or during replacement, the protection member is removed and the cartridge or unit is inserted into an apparatus body.

For example, JP-A-2006-267808 proposes removing a protection cover at a stage where a front end of an image forming unit with a protection cover is inserted into an apparatus body together with a portion of the protection cover that covers the front end of the image forming unit, and further inserting the image forming unit with the protection cover removed.

Japanese Patent No. 3507227 proposes inserting a process cartridge into an apparatus body while a protection cover is left outside the apparatus body.

JP-A-8-292706 proposes a configuration in which a protection member left outside an apparatus body is removed in response to an operation of inserting a cartridge into the apparatus body, as in Japanese Patent No. 3507227.

SUMMARY

Issues during insertion of a replacement component into an apparatus body when a protection member is provided in order to prevent damage to the replacement component do not only arise with respect to an image carrier or an image forming apparatus, but is common issues to apparatuses each of which operates with an inserted replacement component.

Aspects of non-limiting embodiments of the present disclosure relates to providing (i) a protection member that is removable after it is started to insert a replacement component with the protection member attached and in a middle of the insertion, (ii) a replacement component with the protection member, and (iii) an image forming apparatus that operates with the replacement component inserted.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a protection member for attachment to a replacement component before the replacement component is inserted into a body of an apparatus, to protect the replacement component, the replacement component being to be inserted into the body of the apparatus so as to act as a part of the apparatus, the protection member including: a contact portion configured to come into contact with the body of the apparatus at a stage where a portion of the replacement component on a front side in an insertion direction is inserted into the body of the apparatus while the protection member is attached to the replacement component, in which the protection member is removed at the stage where the portion is inserted into the body of the apparatus, so as to allow further insertion of the replacement component.

BRIEF DESCRIPTION OF THE DRAWINGS

Exemplary embodiment(s) of the present disclosure will be described in detail based on the following figures, wherein.

DETAILED DESCRIPTION

Hereinafter, an exemplary embodiment of the present disclosure will be described. Here, as an example, an electrophotographic image forming apparatus will be described.

Figure 1:
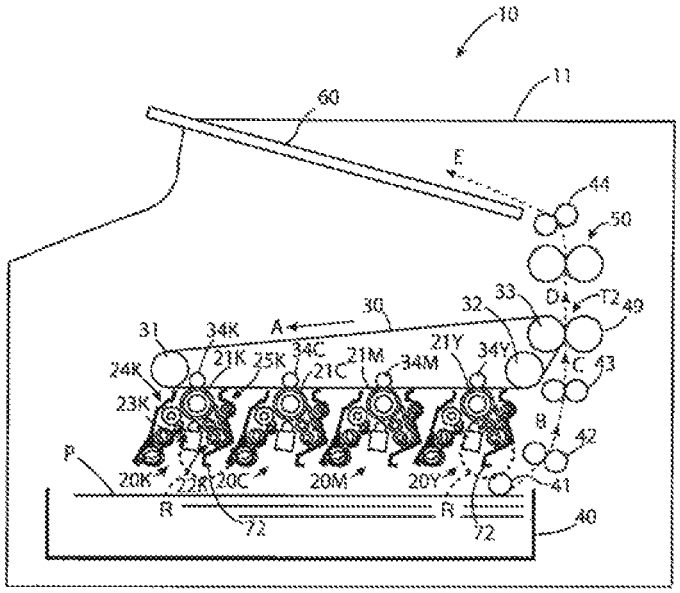
FIG. 1 is a diagram showing an outline of an image forming apparatus according to an exemplary embodiment of the present disclosure.

FIG. 1 is a diagram showing an outline of an image forming apparatus according to an exemplary embodiment of the present disclosure.

An image forming apparatus 10 is provided with four image forming engines 20Y, 20M, 20C, and 20K in an apparatus housing 11. Here, reference sings Y, M, C, and K of the reference numerals 20Y, 20M, 20C, and 20K represent colors of toner. The image forming engines 20Y, 20M, 20C, and 20K form toner images with toner of colors Y, M, C, and K, respectively. In the following, for a description common to the image forming engines 20Y, 20M, 20C, and 20K, which does not need to distinguish the colors of the toner, the reference numerals of Y, M, C, and K which are used to distinguish the colors of the toner will be omitted, and the reference numeral 20 will be used for the image forming engines. The same applies to other elements.

Each image forming engine 20 includes an image carrier 21, and further includes a charging unit 22, an exposure unit 23, a developing unit 24, and a cleaning unit 25 around the image carrier 21. While rotating, the image carrier 21 is subject to actions of the charging unit 22, the exposure unit 23, the developing unit 24, and the cleaning unit 25. That is, the charging unit 22 charges the image carrier 21. The exposure unit 23 irradiates the image carrier 21 with exposure light to form an electrostatic latent image. The developing unit 24 develops the electrostatic latent image with a toner. Then, a toner image formed by the developing is transferred onto an intermediate transfer belt 30 to be described later. The toner remaining on the image carrier 21 after the transfer is removed by the cleaning unit 25.

The intermediate transfer belt 30 is provided immediately above the image forming engines 20 in the apparatus housing 11. The intermediate transfer belt 30 is wound around plural rollers 31 to 33, and circulates in a direction of an arrow A through a path along the image carriers 21. Each primary transfer unit 34 is disposed on an inner side of the intermediate transfer belt 30 at a position where the primary transfer unit 34 faces a respective one of the image carriers 21 with the intermediate transfer belt 30 interposed therebetween. The toner images formed on the image carriers 21 are transferred onto the intermediate transfer belt 30 by actions of the primary transfer units 34 so as to be sequentially overlapped according to circulation of the intermediate transfer belt 30. The toner image transferred onto the intermediate transfer belt 30 is further transported to a secondary transfer position T2.

A sheet tray 40 is provided in a lower portion of the apparatus housing 11. Sheets P before image formation are stacked on the sheet tray 40. For the image formation, one sheet P is taken out from the sheet tray 40 by a pickup roller 41, and is transported by a transport roller 42 in a direction of an arrow B until a leading end of the sheet P reaches a timing adjustment roller 43. Then, the timing adjustment roller 43 feeds the sheet P in a direction of an arrow C such that the sheet P reaches the secondary transfer position T2 at a timing when the toner image on the intermediate transfer belt 30 reaches the secondary transfer position T2. At the secondary transfer position T2, the toner image is transferred onto the sheet P by an action of the secondary transfer unit 49.

The sheet P to which the toner image is transferred is transported in a direction of an arrow D to reach a fixing unit 50. Then, the toner image on the sheet P is heated and pressurized by the fixing unit 50, and is fixed on the sheet P.

The sheet P on which an image formed of the toner image fixed by the fixing unit 50 is formed is fed by a delivery roller 44 onto a discharge tray 60 (see FIG. 5) provided on an upper surface of the apparatus housing 11.

Here, the four image forming engines 20 are formed as one image forming unit as a whole, and are integrally detachably attached to an apparatus body. The apparatus body may also be referred to as a "body of an apparatus". The image forming unit will be described below.

Figure 2:
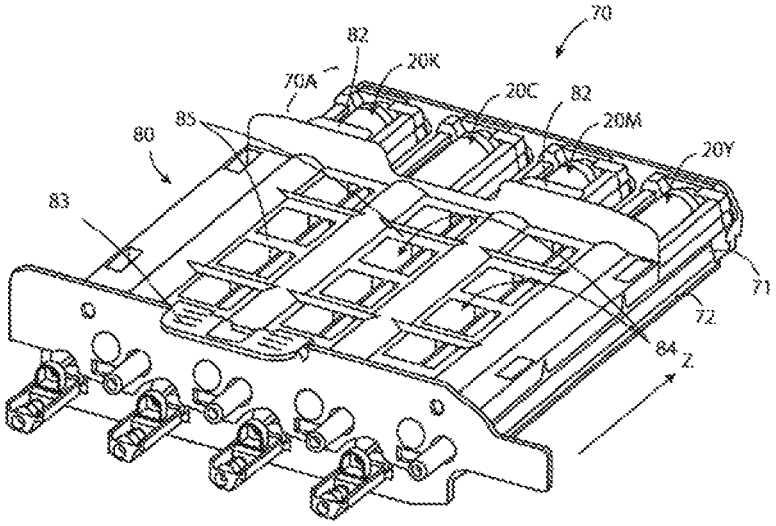
FIG. 2 is a perspective view showing an image forming unit before being attached to an apparatus body.

FIG. 2 is a perspective view showing the image forming unit before being attached to the apparatus body.

This image forming unit 70 is to be inserted into the apparatus body in a direction of an arrow Z so as to act as a part of the apparatus. In the image forming unit 70, the four image forming engines 20 are arranged on a unit housing 71 in a width direction intersecting an insertion direction. The image forming unit 70 includes a protection cover 80.

Here, the image forming unit 70 excluding the protection cover 80 is an example of a "replacement component" of the present disclosure. The four image forming engines 20 constituting the image forming unit 70 correspond to an example of "unit components" of the present disclosure.

The protection cover 80 is attached to the image forming unit 70, which is the example of the "replacement component", before the image forming unit 70 is inserted, so as to protect the image forming unit 70. The protection cover 80 mainly protects the image carriers 21 which is vulnerable to mechanical stimulation, and extends over the four image forming engines 20 constituting the image forming unit 70. The protection cover 80 is an example of a "protection member" of the present disclosure. The image forming unit 70 to which the protection cover 80 is attached is an example of a "replacement component with protection member" of the present disclosure.

Figure 3:
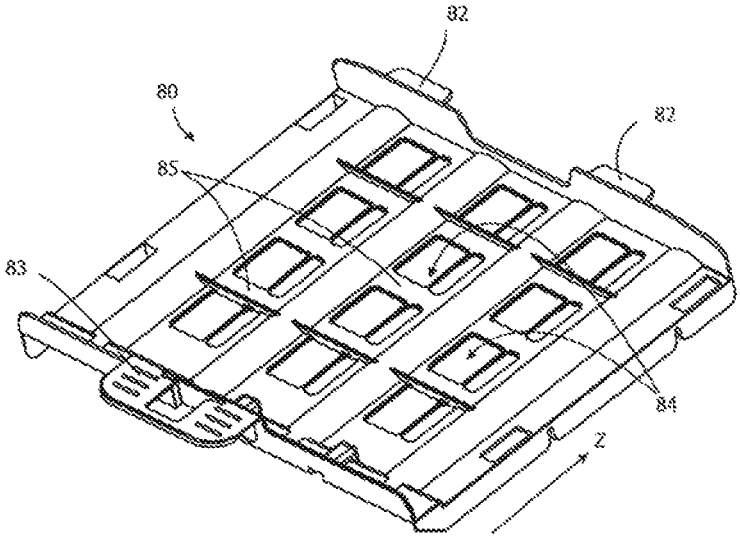
FIG. 3 is a perspective view showing a protection cover such that an upper surface of the protection cover appears.

FIG. 3 is a perspective view showing the protection cover such that an upper surface of the protection cover appears.

Figure 4:
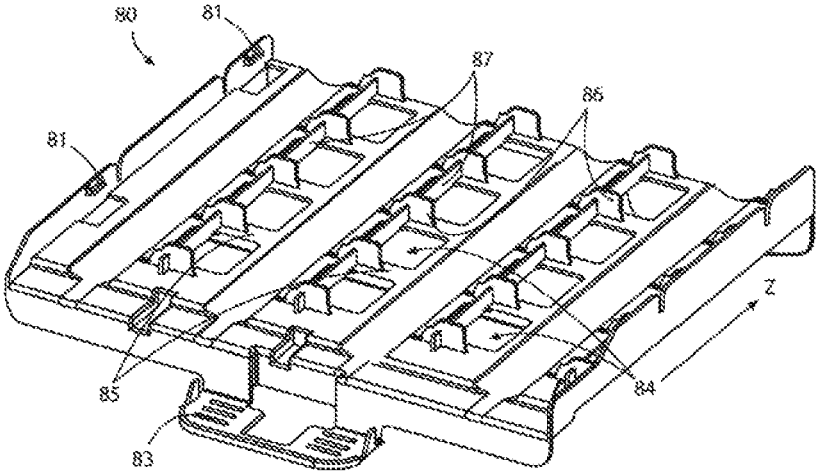
FIG. 4 is a perspective view showing the protection cover such that a lower surface of the protection cover appears.

FIG. 4 is a perspective view showing the protection cover such that a lower surface of the protection cover appears.

Hereinafter, the protection cover 80 will be described with reference to FIGS. 3 and 4 together with FIG. 2.

As shown in FIG. 4, the protection cover 80 is provided with two attachment portions 81 on each of right and left sides in the width direction intersecting the insertion direction. It is noted that FIG. 4 shows the attachment portions 81 on one of the right and left sides. The protection cover 80 is attached to the image forming unit 70 by locking these attachment portions 81 to the unit housing 71.

As shown in FIG. 2, the protection cover 80 leaves an exposed portion 70A of the image forming unit 70 on a front side in the insertion direction indicated by the arrow Z. The protection cover 80 includes contact portions 82 at a front end of the protection cover 80. The image forming unit 70 with the protection cover 80 attached is started to be inserted into the apparatus body. The contact portions 82 come into contact with the apparatus body at a stage where the exposed portion 70A of the image forming unit 70 on the front side in the insertion direction is inserted into the apparatus body, and the image forming unit 70 cannot be further inserted as it is. The protection cover 80 is provided with a handle 83 on a rear side in the insertion direction. The handle 83 receives a removal operation to facilitate removal of the protection cover 80. After inserting the image forming unit 70 until the contact portions 82 contact with the apparatus body, a user removes the protection cover 80 by holding the handle 83 with his hand. Then, the image forming unit 70 enters a state where the image forming unit 70 may be further inserted into an apparatus body 10A. The image forming unit 70 is inserted to a predetermined position in the apparatus body 10A with the protection cover 80 removed. Inserting the image forming unit 70 into the apparatus body 10A will be described later.

The protection cover 80 covers upper portions of the image carriers 21 which are vulnerable to mechanical impact, and has windows 84 each opening on a portion between the adjacent image forming engines 20. The protection cover 80 is a lightweight and material-saving protection cover because of the windows 84.

Plural windows 84 are arranged in the insertion direction. Window frames 85 separate the windows 84 adjacent in the insertion direction from each other. Ribs 86 having a shape shown in FIG. 4 are formed on surfaces of the window frames 85 that are to face the image forming unit 70. These ribs 86 are reinforced by beams 87 extending in the insertion direction. These ribs 86 enter between the adjacent image forming engines 20, and prevent rattling of the replacement component before attachment, for example, during transportation. These ribs 86 are an example of "protruding portions" of the present disclosure.

Figure 5:
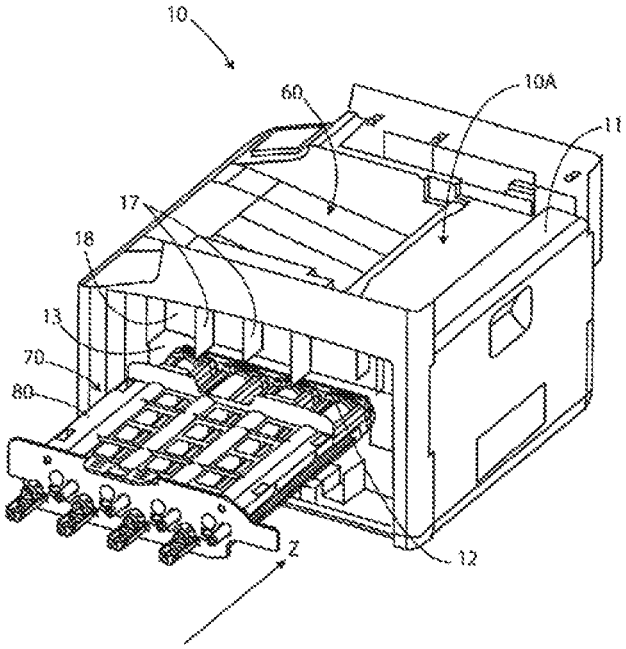
FIG. 5 is a perspective view showing at an initial stage of inserting the image forming unit into the apparatus body.

FIG. 5 is a perspective view showing an initial stage of inserting the image forming unit into the apparatus body.

A panel (not shown) that forms an external appearance is provided on a side of the apparatus body 10A. The panel is opened and closed with a lower end of the panel serving as a hinge. When the panel is opened, an insertion port 12 provided in a frame 13 which is a part of the apparatus housing 11 is opened there. The image forming unit 70 is inserted into the apparatus body 10A through the insertion port 12 while the exposed portion 70A not covered by the protection cover 80 is located at a leading end thereof and the protection cover 80 covers the image forming unit 70.

A toner cartridge attaching member 18 fixed to the frame 13 constituting a part of the apparatus housing 11 is provided above the insertion port 12. The toner cartridge attaching member 18 includes plural partition plates 17. A toner cartridge (not shown) is attached to a space of the toner cartridge attaching member 18 between the partition plates 17. A toner contained in the attached toner cartridge is used for forming a toner image by the developing unit 24 (see FIG. 1).

Figure 6:
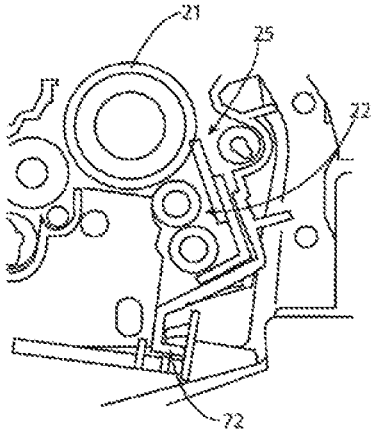
FIG. 6 is an enlarged view of a portion indicated by a circle R in FIG. 1.

FIG. 6 is an enlarged view of a portion indicated by a circle R in FIG. 1. In FIG. 1, the circles R are shown in two places, and both have the same shape.

The image forming unit 70 is provided with guide rails 72 extending in the insertion direction (that is, a direction perpendicular to the sheets of FIGS. 1 and 6) at a position in the circle R shown in FIG. 1. The image forming unit 70 is inserted into the apparatus body 10A while these two guide rails 72 are guided by the apparatus body 10A.

Figure 7:
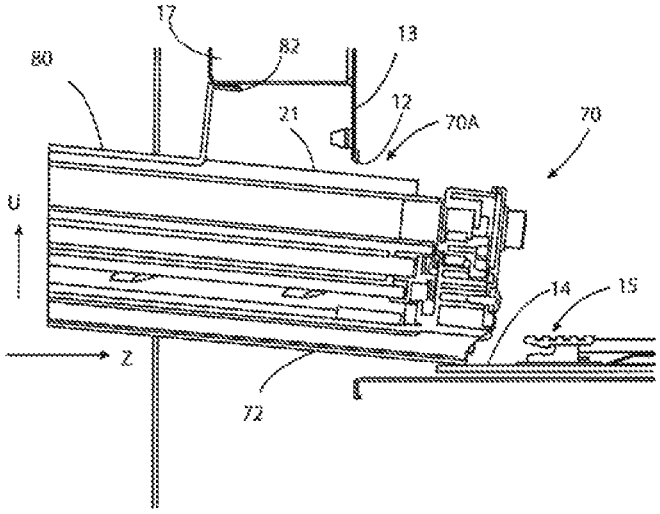
FIG. 7 is a cross-sectional view showing a part of the apparatus body and the image forming unit at the initial stage of the insertion.

FIG. 7 is a cross-sectional view showing a part of the apparatus body and the image forming unit at the initial stage of the insertion.

It is expected that the image forming unit 70 is horizontally inserted into the apparatus body 10A in the direction of the arrow Z. However, at the initial stage of insertion, a rear side of the image forming unit 70 may be lifted up in a direction of an arrow U as shown in FIG. 7. In this case, the contact portions 82 of the protection cover 80 first come into contact with the partition plates 17 (see FIG. 5) to prevent the image forming unit 70 from contacting with the frame 13. That is, even when the contact portions 82 of the protection cover 80 contact with the partition plates 17, the exposed portion 70A of the image forming unit 70 where the image carrier 21 and the like are exposed is located at a position away from the frame 13 defining the insertion port 12. In this way, during the insertion of the image forming unit 70, damage to the exposed portion 70A is prevented.

Figure 8:
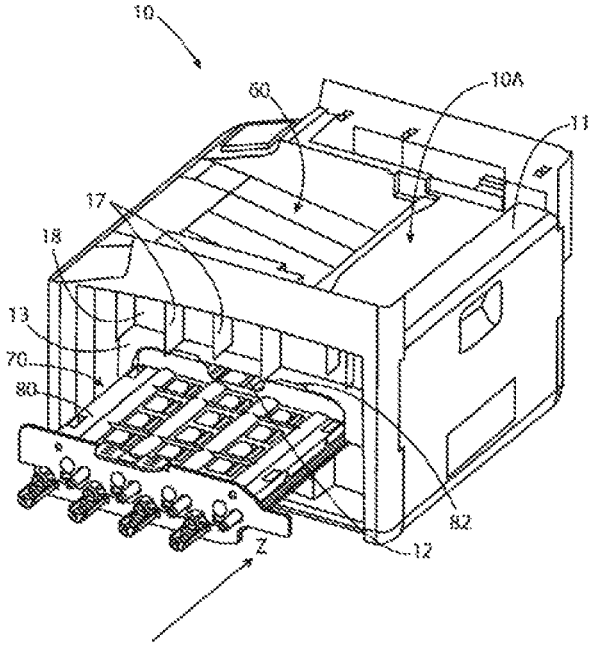
FIG. 8 is a perspective view showing a state to which an operation of inserting the image forming unit into the apparatus body proceeds from the state shown in FIG. 5.

FIG. 8 is a perspective view showing a state to which an operation of inserting the image forming unit into the apparatus body proceeds from the state shown in FIG. 5.

In FIG. 8, the contact portions 82 of the protection cover 80 abut against the frame 13. With the image forming unit 70 inserted so far, the protection cover 80 is removed from the image forming unit 70.

Figure 9:
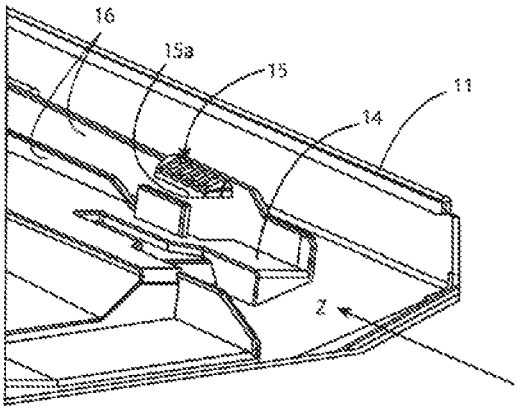
FIG. 9 is a perspective view showing a falling-off prevention structure provided in the apparatus body.

FIG. 9 is a perspective view showing a falling-off prevention structure provided in the apparatus body.

FIG. 9 shows a support portion 14, a retaining portion 15, and a guide portion 16 in order from a near side in a direction indicated by the arrow Z in which the image forming unit 70 is inserted. The support portion 14, the retaining portion 15, and the guide portion 16 are provided in the apparatus housing 11. A set including the support portion 14, the retaining portion 15, and the guide portion 16 is provided on each of the right and left sides such that the sets correspond to the right and left guide rails 72 shown by the two circles R in FIG. 1.

After the contact portions 82 abut against the apparatus body 10A as shown in FIG. 8, the removal operation of removing the protection cover 80 is performed, but at this time, the user may let go of the image forming unit 70. In a state shown in FIG. 8, only the exposed portion 70A of the image firming unit 70 on the front side is inserted, and a center of gravity of the image forming unit 70 is still outside the apparatus body 10A. Therefore, when the user lets go of the image forming unit 70, the own weight of the image forming unit 70 acts on the image forming unit 70, and the image forming unit 70 may fall off from the apparatus body 10A and drop. In the present exemplary embodiment, the support portions 14 and the retaining portions 15 prevent the image forming unit 70 from falling off.

Figure 10:
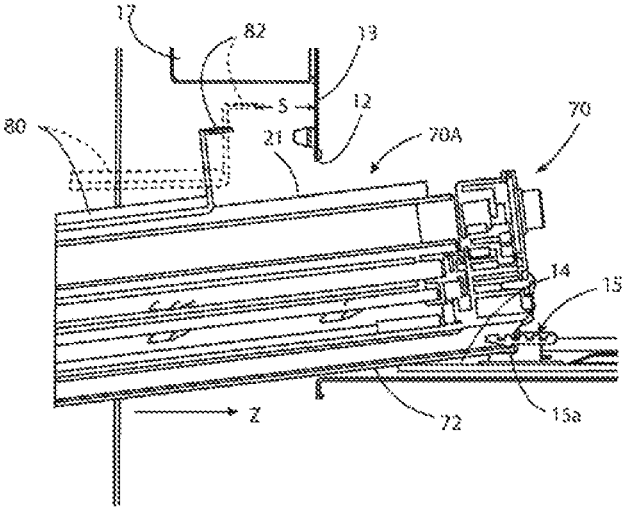
FIG. 10 is a cross-sectional view showing a part of the apparatus body and the image forming unit in a state where falling off is prevented.

FIG. 10 is a cross-sectional view showing the part of the apparatus body and the image forming unit in a state where the falling off is prevented.

The guide rail 72 of the image forming unit 70 rides on the support portion 14, and a front end of the guide rail 72 is hooked on a hook portion 15*a* of the retaining portion 15 protruding downward. Thus, the image forming unit 70 is prevented from falling off.

FIG. 10 also shows, with a broken line, the protection cover 80 when the image forming unit 70 is inserted straightly in the direction of the arrow Z to the same position as the position where the image forming unit 70 is prevented from falling off. When the image forming unit 70 is in this position, the contact portion 82 of the protection cover 80 is apart from the frame 13 with a slight space S between the contact portion 82 and the frame 13.

After the contact portions 82 abut against the apparatus body 10A, the protection cover 80 is removed from the image forming unit 70. The handle 83 of the protection cover 80 is disposed on the rear side. In removing the protection cover 80, the user lets go of the image forming unit 70 once after the contact portions 82 abut against the apparatus body 10A. Then, the image forming unit 70 is in a posture shown with a solid line in FIG. 10. Thereafter, the user lifts the handle 83 of the protection cover 80 disposed on the rear side by his hand. Since there is the space S between the position where the contact portion 82 of the protection cover 80 abuts against the apparatus body 10A and the position where the image forming unit 70 is prevented from falling off, the protection cover 80 may be safely removed without dropping the image forming unit 70 even when the user lets go of the image forming unit 70 once. In the present exemplary embodiment, since the handle 83 is disposed on the rear side, the protection cover 80 may be removed if there is a slight space S. If the handle 83 is disposed on a lateral side, a larger space is required, which may hinder miniaturization.

After the protection cover 80 is removed, the image forming unit 70 is inserted while the guide rails 72 of the image forming unit 70 are guided by the guide portions 16 (see FIG. 9) of the apparatus housing 11.

In pulling out the used image forming unit 70, the image forming unit 70 is pulled out while the guide rails 72 are guided by the guide portions 16. At this time, when the image forming unit 70 is pulled out until the center of gravity of the image forming unit 70 is located outside the apparatus housing 11, the image forming unit 70 may drop.

The support portions 14 and the retaining portions 15 also contribute to preventing inadvertent drop at this time.

Here, as the protection cover 80, a protection cover that leaves a portion of the front side of the image forming unit 70 exposed has been described. It is noted that the protection cover does not need to leave a portion of the image forming unit 70 exposed. For example, a second protection cover may be provided. The second protection cover covers the exposed portion 70A of the image forming unit 70 and is slidable so as to overlap the protection cover that covers a portion other than the exposed portion 70A. The user brings the second protection cover to abut against the frame 13 and sliding the second protection cover, the portion of the image forming unit 70 covered with the second protection cover before being inserted is inserted without a cover.

The image forming unit 70 in which the plural image forming engines 20 constituting the electrophotographic image forming apparatus 10 are arranged and the protection cover 80 that protects the image forming unit 70 have been described as an example so far. It sis noted that the present disclosure is not limited to this example.

For example, a module including the intermediate transfer belt 30 may be another example of the "replacement component" of the present disclosure.

The replacement component of the present disclosure may not be a replacement component of the image forming apparatus 10, but may be a replacement component of an apparatus for another purpose. That is, the replacement component of the present disclosure may be a replacement component that is to be inserted into a body of an apparatus so as to act as a part of the apparatus.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A protection member comprising:

a contact protrusion configured to contact an image forming apparatus if a portion of a replacement component, which is attached to the contact protrusion, is inserted into a body of the image forming apparatus in an insertion direction, wherein the contact protrusion is provided at a front end of the protection member in the insertion direction, wherein the contact protrusion protrudes primarily in the insertion direction, wherein the protection member is removable after the portion is inserted into the body, so as to allow further insertion of the replacement component, and wherein the protection member comprises:

one or more windows arranged in the insertion direction.

2. The protection member according to claim 1, wherein the protection member is configured to not cover the contact protrusion and to leave the contact protrusion exposed.

3. The protection member according to claim 2, further comprising:

a handle disposed on a rear side of the protection member in the insertion direction, the handle being configured to receive a removal operation.

4. The protection member according to claim 3, wherein the replacement component comprises a plurality of unit parts extending in the insertion direction, the unit parts being arranged in a width direction intersecting the insertion direction, and wherein the one or more windows is a plurality of windows, wherein the protection member comprises:

a protrusion on a surface of a window frame that separates adjacent windows, wherein the surface of the window frame faces the replacement component, and wherein the protrusion is between adjacent ones of the unit parts.

5. A replacement component comprising:

the protection member according to claim 4, wherein the replacement component is configured to be inserted into the body so as to act as a part of the image forming apparatus and to allow the image forming apparatus to operate to form a toner image, and transfer and fix the toner image on a sheet.

6. A replacement component comprising:

the protection member according to claim 3, wherein the replacement component is configured to be inserted into the body so as to act as a part of the image forming apparatus and to allow the image forming apparatus to operate to form a toner image, and transfer and fix the toner image on a sheet.

7. The protection member according to claim 2, wherein the replacement component comprises a plurality of unit parts extending in the insertion direction, the unit parts being arranged in a width direction intersecting the insertion direction, and wherein the one or more windows is a plurality of windows, wherein the protection member comprises:

a protrusion on a surface of a window frame that separates adjacent windows, wherein the surface of the window frame faces the replacement component, and wherein the protrusion is between adjacent ones of the unit parts.

8. A replacement component comprising:

the protection member according to claim 7, wherein the replacement component is configured to be inserted into the body so as to act as a part of the image forming apparatus and to allow the image forming apparatus to operate to form a toner image, and transfer and fix the toner image on a sheet.

9. A replacement component comprising:

the protection member according to claim 2, wherein the replacement component is configured to be inserted into the image forming apparatus so as to act as a part of the image forming apparatus and allow the image forming apparatus to form a toner image, and transfer and fix the toner image on a sheet.

10. The protection member according to claim 1, further comprising:

a handle disposed on a rear side of the protection member in the insertion direction, the handle being configured to receive a removal operation.

11. The protection member according to claim 10, wherein the replacement component comprises a plurality of unit parts extending in the insertion direction, the unit parts being arranged in a width direction intersecting the insertion direction, and wherein the one or more windows is a plurality of windows, wherein the protection member comprises:

a protrusion on a surface of a window frame that separates adjacent windows, wherein the surface of the window frame faces the replacement component, and wherein the protrusion is between adjacent ones of the unit parts.

12. A replacement component comprising:

the protection member according to claim 11, wherein the replacement component is configured to be inserted into the body so as to act as a part of the image forming apparatus and to allow the image forming apparatus to operate to form a toner image, and transfer and fix the toner image on a sheet.

13. A replacement component comprising:

the protection member according to claim 10, wherein the replacement component is configured to be inserted into the body so as to act as a part of the image forming apparatus and to allow the image forming apparatus to operate to form a toner image, and transfer and fix the toner image on a sheet.

14. The protection member according to claim 1, wherein the replacement component comprises a plurality of unit parts extending in the insertion direction, the unit parts being arranged in a width direction intersecting the insertion direction, and wherein the one or more windows is a plurality of windows, wherein the protection member comprises:

a protrusion on a surface of a window frame that separates adjacent windows, wherein the surface of the window frame faces the replacement component, and wherein the protrusion is between adjacent ones of the unit parts.

15. A replacement component comprising:

the protection member according to claim 14, wherein the replacement component is configured to be inserted into the body so as to act as a part of the image forming apparatus and to allow the image forming apparatus to operate to form a toner image, and transfer and fix the toner image on a sheet.

16. A replacement component comprising:

the protection member according to claim 1, wherein the replacement component is configured to be inserted into the image forming apparatus so as to act as a part of the image forming apparatus and allow the image forming apparatus to form a toner image, and transfer and fix the toner image on a sheet.

17. The replacement component according to claim 16, wherein the replacement component is a component comprising an image carrier configured to be subject to the formation of the toner image and temporarily carry the toner image until the toner image is transferred to a transfer body.

18. The replacement component according to claim 17, wherein the replacement component is a component in which a plurality of image carriers are arranged in a width direction intersecting the insertion direction, and wherein the protection member is a component that extends over the plurality of arranged image carriers.

19. An image forming apparatus comprising:

a body; and a replacement component configured to be inserted into the body so as to act as a part of the image forming apparatus and allow the image forming apparatus to operate to form a toner image, and transfer and fix the toner image on a sheet, wherein the body comprises:

a falling-off prevention structure configured to prevent the replacement component from falling off from the body if an own weight of the replacement component acts in a state where a portion of the replacement component on a front side in an insertion direction is inserted into the body, wherein the image forming apparatus further comprises a protection member configured to be attached to the replacement component before the replacement component is inserted into the body, to protect the replacement component, wherein the protection member comprises a contact protrusion configured to contact the body if the portion of the replacement component on the front side in the insertion direction is inserted into the body while the protection member is attached to the replacement component, wherein the contact protrusion is provided at a front end of the protection member in the insertion direction, wherein the contact protrusion protrudes primarily in the insertion direction, wherein the protection member is removable after the replacement component is inserted into the body so as to allow further insertion of the replacement component, and wherein the protection member comprises:

one or more windows arranged in the insertion direction.

* * * * *